United States Patent [19]

Carlson et al.

[11] 4,288,951

[45] Sep. 15, 1981

[54] AUXILIARY INSULATED ROOF SYSTEM

[75] Inventors: Denny L. Carlson; David C. Brissey, both of Iowa City; Lee W. Vriezelaar, Pella, all of Iowa

[73] Assignee: Scientific Applications Incorporated, Mount Pleasant, Iowa

[21] Appl. No.: 94,222

[22] Filed: Nov. 14, 1979

[51] Int. Cl.[3] ..... E04B 7/00; E04D 13/16

[52] U.S. Cl. ..... 52/94; 52/3; 52/262; 52/268; 52/309.1; 52/309.4; 52/309.8; 52/404; 52/410; 52/743

[58] Field of Search ..... 52/309.1, 309.4, 309.8, 52/3, 22, 23, 94, 262, 540, 249, 268, 366, 410, 743, 404

[56] References Cited

U.S. PATENT DOCUMENTS

| | | | |
|---|---|---|---|
| 1,376,215 | 4/1921 | Millard | 52/22 X |
| 1,585,987 | 5/1926 | Hennessy | 52/94 X |
| 2,409,342 | 10/1946 | Cassidy | 52/684 |
| 2,629,347 | 2/1953 | Wittrien | 52/22 X |
| 3,517,468 | 6/1970 | Woods | 52/309.8 X |
| 3,763,614 | 10/1973 | Hyde et al. | 52/408 |
| 4,045,922 | 9/1977 | Elliott | 52/408 X |

FOREIGN PATENT DOCUMENTS

| | | | |
|---|---|---|---|
| 914125 | 12/1962 | United Kingdom | 52/309.8 |

*Primary Examiner*—Alfred C. Perham

*Attorney, Agent, or Firm*—Zarley, McKee, Thomte, Voorhees & Sease

[57] ABSTRACT

An auxiliary insulated roof system for mobile homes, metal buildings and the like includes a generally continuous panel structure of insulation material, a plurality of insulated support blocks for supporting the panel structure in clearance relation above the building roof surface and a plurality of fastening brackets for securing the panel structure to the building sidewalls. The insulated support blocks may include a base plate having a stud extended from one side for penetrating the panel structure and a block of insulation material secured to the opposite side thereof. The insulation blocks may be connected to elongated straps at spaced-apart positions therealong with opposite ends of the straps secured to the building sidewalls for partially securing the panel structure in place. A trim strip covers the fastening brackets and opening between the panel structure and roof surface.

The panel structure includes a plurality of panels of insulation material, the panels having rabbeted ends and being arranged to end-to-end shiplapped relation. A cover sheet is secured to the exterior surface of each panel and includes an overlap portion at one end which is adapted to overlie and be secured to the adjacent panel to form a continuous panel structure.

13 Claims, 6 Drawing Figures

AUXILIARY INSULATED ROOF SYSTEM

BACKGROUND OF THE INVENTION

The present invention is directed generally to insulated roof structures and more particularly to an improved insulation panel structure and system for insulating the roof surfaces of mobile homes, metal building and like structures.

Mobile homes, camper trailers, and certain stationary building structures have relatively thin roof structures which characteristically have certain problems. The thermal insulation properties of some such roof structures are less than desirable resulting in heat loss in the winter and significant solar heat load during the summer. In addition, expansion and contraction of the roof skin in response to temperature changes cause an annoying roof-rumble and eventually result in leakage due to the opening of seams and penetration seals. Furthermore, as the roof skin temperature decreases, the chances of forming condensation increase. Even aside from thermal insulation problems, the generally thin skinned roof surfaces are subject to such other problems as wind noise and hail damage. As a result of these problems, yearly maintenance of the roof surfaces of such buildings is necessary in many cases.

Even if the roof surface were to be insulated, there is the further problem that insulation panels as large as the roof surface would be unwieldly and impractical yet the use of a plurality of smaller panels necessarily requires numerous seams which are subject to leakage. Accordingly, there is a need for an improved insulation panel structure as well as an improved system for insulating the roof surfaces of mobile homes, metal building and the like.

A primary object of the invention therefore is to provide an improved insulation panel structure.

A further object is to provide an improved insulation panel structure comprised of a plurality of smaller panels of insulation material.

A further object is to provide an improved insulation panel structure wherein the seams between separate panels are permanently and securely sealed.

Another object is to provide an improved auxiliary insulation roof system for mobile homes and the like.

A further object is to provide an auxiliary insulated roof structure which tends to stabilize the roof skin temperature, thereby stabilizing expansion, contraction and condensation.

A further object is to provide an improved auxiliary insulation roof structure which protects the roof surface from the elements such as wind and hail.

A further object is to provide an auxiliary insulated roof structure which is substantially stronger than the panels of insulation material which it comprises.

Another object is to provide an auxiliary insulation roof system which may be quickly and easily installed.

Another object is to provide an auxiliary insulated roof system which eliminates the necessity for annual maintenance.

Finally, another object is to provide an improved insulation panel structure and auxiliary insulated roof structure which are simple in construction, economical to manufacture, durable in use and efficient in operation.

SUMMARY OF THE INVENTION

An auxiliary insulated roof system for mobile homes, metal buildings and the like includes a generally continuous panel structure of insulation material, a plurality of insulated support blocks for maintaining the panel structure in spaced relation from the building roof surface and a plurality of fastening brackets for securing the panel structure to the building sidewalls. The continuous panel structure affords thermal insulation which reduces heat loss in the winter as well as the solar heat load during the summer. The resultant stabilization of the roof skin temperature reduces condensation as well as the expansion and contraction associated with temperature changes. Roof-rumble due to wind and physical damage due to hail are also substantially eliminated by the protective insulated roof structure of the present invention. Since the roof structure is attached only to the sidewalls and requires no penetration of the original roof surface, installation of the auxiliary roof structure of the present invention creates no new sources for possible leakage. The insulated support blocks lessen the chance of thermal condensation due to thermal short circuits and tend to prevent corrosion and rusting due to entrapped moisture by maintaining the auxiliary roof structure off of the original roof surface.

The improved insulation panel structure of the present invention enables a series of insulation panels to be joined together in end-to-end shiplapped relation to form a generally integral continuous panel structure. The cover sheets which are secured to the exterior surfaces of the panels are offset toward one end so as to provide overlap portions which may be secured to the exterior surface of the adjacent panel for sealing the seam between adjacent panels and substantially strengthening the resulting assembly. The cover sheets may be formed of fiberglass or the like to substantially strengthen the compressive qualities of the insulation panels. Accordingly, the improved panel structure and auxiliary insulated roof system of the present invention are adapted to insulate, protect and strengthen the surface on which they are installed.

DESCRIPTION OF THE PREFERRED EMBODIMENT

Figure 1:
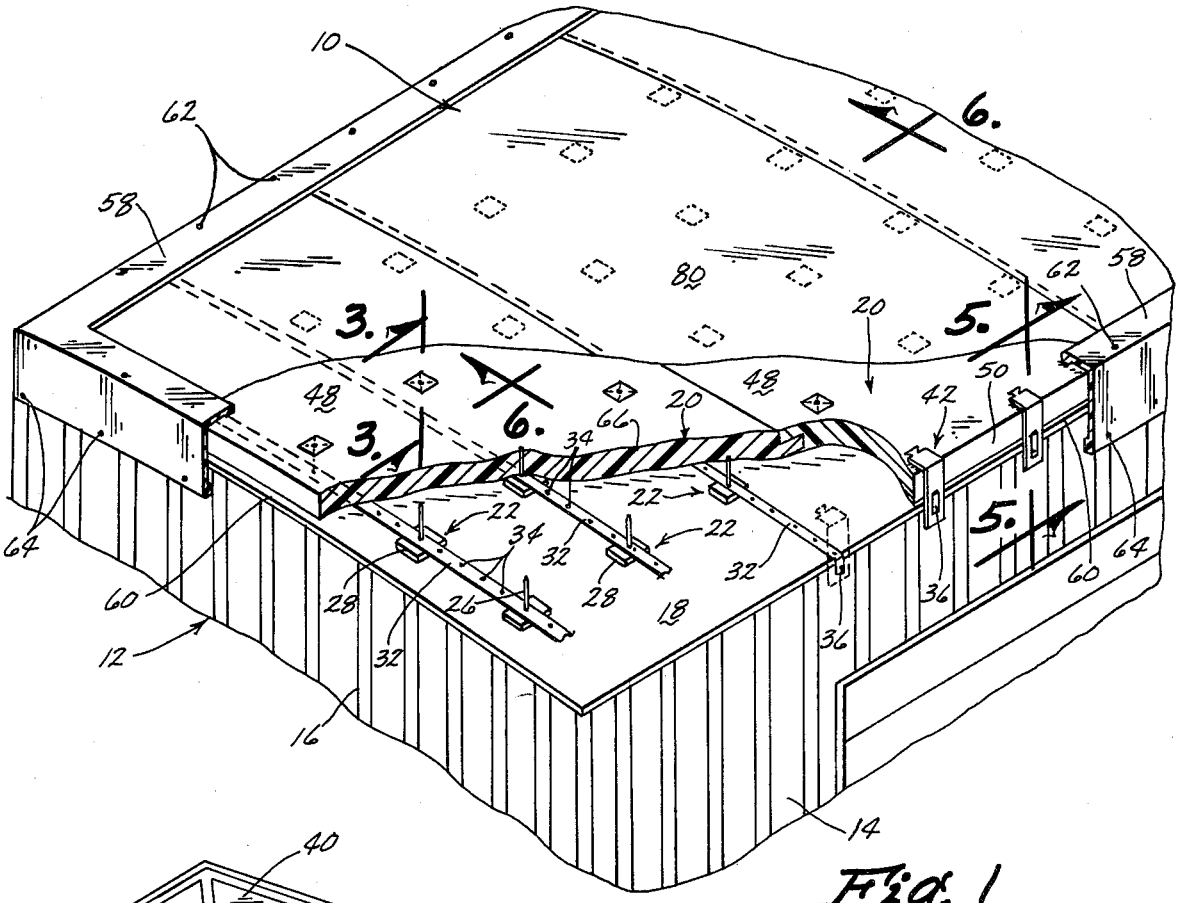
FIG. 1 is a foreshortened and partially fragmented perspective view of a mobile home equipped with the auxiliary roof structure of the present invention, with portions broken away for clarity.

The auxiliary insulated roof structure 10 is shown in FIG. 1 in assembly relation with a mobile home 12 including opposite sidewalls 14, opposite end walls 16 and a roof surface 18 connected to and extended between the upper ends of the sidewalls and end walls.

The auxiliary roof structure of the present invention includes a generally continuous panel structure 20 of insulation material supported in clearance relation above the roof surface 18 by a plurality of insulated support blocks 22.

Figure 2:
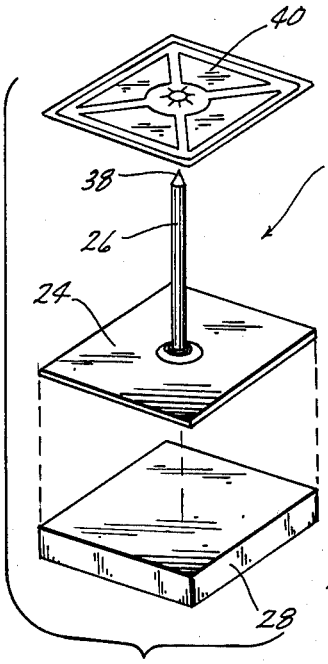
FIG. 2 is an enlarged detail perspective view of an insulated support block of the invention.

In FIG. 2, a support block 22 is shown as including a base plate 24 having an elongated stud 26 secured to and extended from one side and a block 28 of insulation material secured to its opposite side by a layer of adhesive 30 (FIG. 3) or any other suitable means.

To properly space the support blocks 22 on the roof surface 18, a plurality of elongated straps 32 are provided. The straps 32 have spaced-apart holes 34 for receiving the studs 26 and thereby maintaining the support blocks 22 in predetermined spaced-apart relation. The straps 32 are slightly longer than the width of the mobile home roof surface 18 for the purpose of providing downturned end portions 36 for a purpose described hereinbelow.

Figure 3:
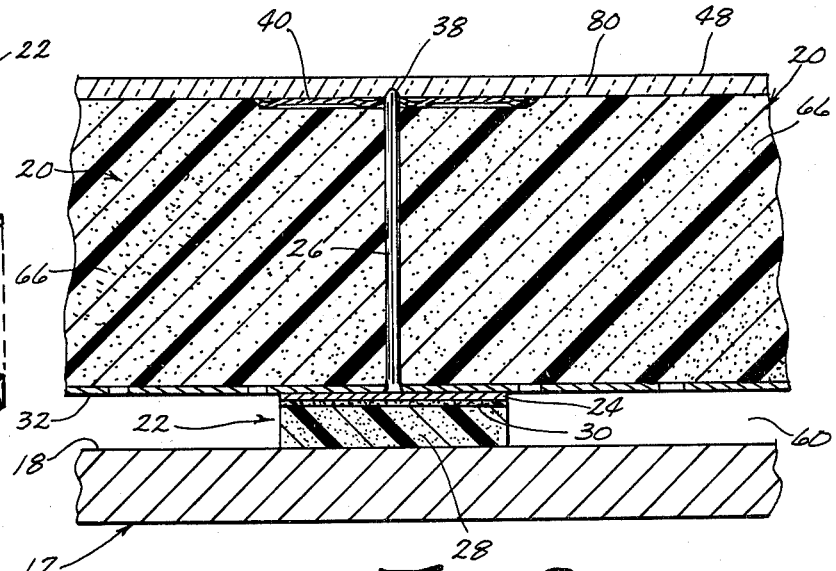
FIG. 3 is an enlarged end sectional view of an insulated support block in the completed roof structure, as seen on line 3—3 in FIG. 1.
Figure 4:
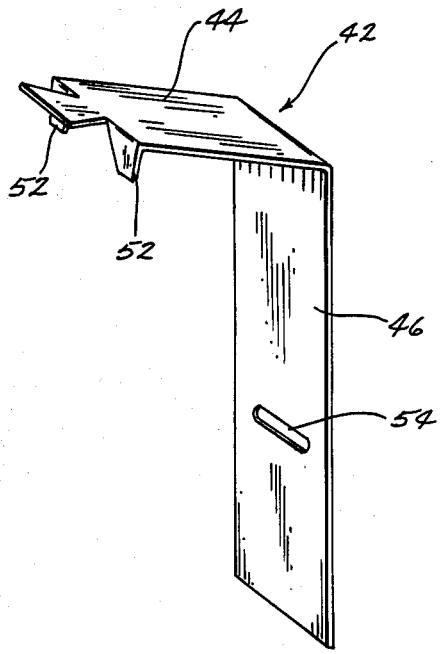
FIG. 4 is an enlarged detail perspective view of a fastening bracket of the invention.

The straps 32, support blocks 22 and panel structure 20 are assembled together prior to placement on the mobile home roof surface 18. In FIG. 3, it is seen that the strap 32 is interposed between the panel structure 20 and base plate 24 and that the stud 26 has a free end 38 which protrudes through the panel structure 20 for receiving a self-locking washer 40 or other suitable fastener to sandwich the panel structure 20 between the fastener and base plate.

Figure 5:
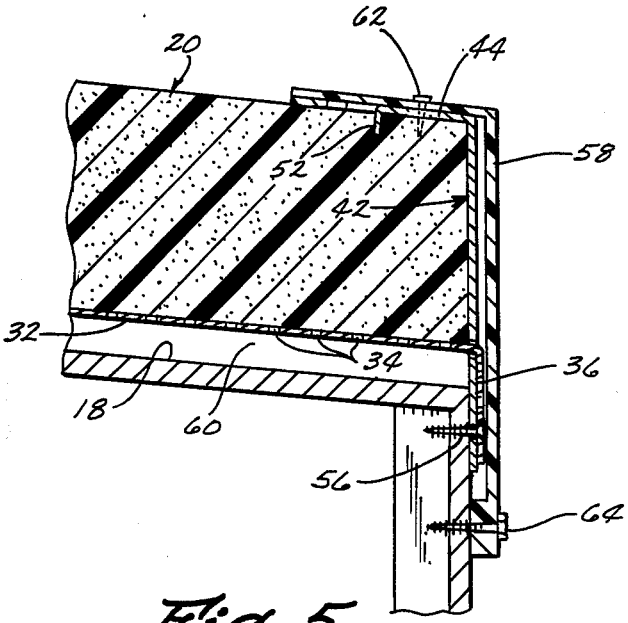
FIG. 5 is an enlarged end sectional view of the fastening bracket and trim member as assembled in the roof structure of the invention as seen on line 5—5 in FIG. 1.

To secure the panel structure onto the roof surface 18, a plurality of generally inverted L-shaped brackets 42 are provided, each bracket having an upper leg 44 and a lower leg 46. The upper leg 44 lies flush on the top surface 48 of panel 20 with the lower leg engaged flush against the side edge 50 of the panel. The upper leg 44 is provided with a pair of spaced-apart downturned flanges 52 which penetrate the panel structure 20 as shown in FIG. 5. The lower leg 46 is provided with an opening 54 which is spaced from the upper leg 44 by approximately the thickness of the panel structure 20 so as to be approximately aligned with the strap 32 for receiving the downturned end portion 36 as shown in FIG. 5. A fastener such as screw 56 is then inserted through the strap end portion 36, the lower leg 46 and mobile home sidewall 14 to rigidly secure the panel structure in place.

An elongated trim member 58 having a generally inverted L-shaped cross section covers the bracket 42 and clearance space 60 between the panel structure 20 and roof surface 18. In FIGS. 1 and 5, it is seen that screws 62 secure a generally horizontal flange of trim member 58 to the upper leg 44 of bracket 42 and a series of screws 64 secure the generally vertical flange of the trim member directly to the building sidewall 14.

Figure 6:
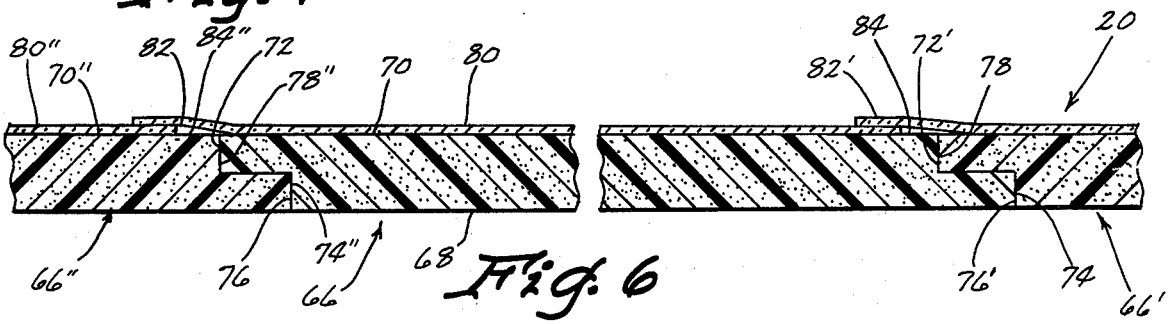
FIG. 6 is an enlarged transverse sectional view of the panel structure of the invention as seen on line 6—6 in FIG. 1.

Panel structure 20 is shown in FIG. 6 as including a panel 66 of insulation material which has interior and exterior surfaces 68 and 70 and opposite ends 72 and 74. End 72 is rabbeted as at 76 along the interior surface thereof and the opposite end 74 is rabbeted as at 78 along the exterior surface thereof so as to cooperate with the rabbeted end 72' of an adjacent panel 66' to form a shiplapped joint when the panels are arranged in end-to-end relation as shown.

A cover sheet 80 is secured to the exterior surface 70 of panel 66 at a position offset toward one end 72 so as to define an overlap portion 82 which extends beyond the panel end 72 for securement to the exterior surface 70'' and cover sheet 80'' of a like panel 66'' arranged in end-to-end shiplapped relation with the end 72 of panel 66. Note that the cover sheet 80 does not extend to the opposite end 74 of panel 66, but rather further defines an exposed end portion 84 of exterior surface 70, which exposed end portion is adapted for securement to the overlap portion 82' of the like panel 66'.

In a preferred embodiment, the panels 66 are formed of two-inch thick expanded polystyrene having a width of 48 inches and a length equal to the width of the mobile home 12. The expanded polystyrene (E.P.S.) density is approximately 1.05 pounds per cubic foot. The cover sheet 80 consists of a 20×10 fiberglass scrim embedded in a 20 mil dry thickness coating of an acrylic latex compound. The cover sheets 80 may be provided with the fiberglass scrim embedded in a 4–6 mil dry thickness coat of compound with additional coats of the compound to be field applied during installation.

In operation, the straps 32 and insulated support blocks 22 are attached to each panel 66 prior to placement on the roof 18 as previously stated. In the embodiment shown in FIG. 1, three straps are arranged on each four foot panel 66 with at least one support block 22 per four square feet of surface area. The panels 66 are arranged on roof surface 18 in end-to-end shiplapped relation as indicated in FIG. 6 with the overlap portion 82 of each panel overlying the exposed end portion 84 and a portion of cover sheet 80 of the adjacent panel. The edge clips or L-brackets 42 are then secured in place. Note that the L-brackets 42 are to be installed along the upper edges of both end walls 16 as well as along the sidewalls 14 to thereby hold down the leading and trailing edges of the auxiliary insulated roof structure 10. The trim member 58 is then secured in place along the entire periphery of the auxiliary roof structure in the manner shown in FIG. 5. A final coating of the acrylic latex compound is then applied to seal the seams between the overlapped cover sheets 80 of adjacent panel 66 and to seal the seams between the trim member 58 and the panel structure. For additional protection, a polyester joint tape or the like may be applied to seal the top edge of the vinyl trim member 58 to the panel structure 20 and to seal the seams between the overlapped cover sheets 80 prior to application of the final coating of the acrylic latex compound.

Whereas the invention has been shown and described as installed on a mobile home, the auxiliary insulated roof system of the invention may alternatively be installed on pre-engineered metal and pole buildings and other stationary structures for which similar roof problems may be effectively resolved by the present invention.

Accordingly, there has been shown and described an improved insulation panel structure and an improved auxiliary insulation roof system for mobile homes, metal buildings and the like which satisfy at least all of the stated objects.

We claim:

1. An auxiliary insulated roof structure for a mobile home or the like including opposite upstanding sidewalls and a roof structure operatively connected to and extended between upper ends of the sidewalls, comprising, a generally continuous panel structure of insulation material, a plurality of insulated support blocks adapted to be interposed between said panel structure and roof surface for maintaining said panel structure in clearance relation above said roof surface, and a plurality of fastening brackets adapted for securement to said panel structure and building sidewalls for fixing said panel structure relative to a roof surface, an elongated strap, means for securing said strap to a plurality of insulated support blocks for maintaining said blocks in spaced-apart relation, and said strap including end portions adapted for securement to said fastening brackets.

2. The auxiliary insulated roof structure of claim 1 further comprising an elongated generally inverted L-section trim member adapted to cover said fastening brackets and clearance space between said panel structure and roof surface, and means for securing said trim member relative to said panel structure.

3. In combination with a building structure including opposite upstanding sidewalls, opposite upstanding end walls and a roof surface operatively connected to and extended between upper ends of said sidewalls and end walls, an auxiliary insulated roof structure comprising a generally continuous panel structure of insulation material, support means interposed between said panel structure and roof surface for maintaining said panel structure in clearance relation above said roof surface, and fastening means secured to said panel structure and building sidewalls for fixing said panel structure in position on said roof surface, said support means comprising a plurality of insulated support blocks, each block comprising a base plate, an elongated stud secured to and extended from one side of said base plate at a generally perpendicular angle thereto, and a block of insulation material secured to the opposite side of said base plate.

4. The combination of claim 3 wherein said panel structure is pierced by said studs and operatively supported on said base plates, said base plates being spaced from said roof surface by said blocks of insulation material.

5. The combination of claim 4 wherein a plurality of said studs each includes a free end protruding through said panel structure and further comprising a fastener adapted for securement to said free end so as to sandwich the panel structure between said base plate and fastener.

6. The combination of claim 5 wherein said fastener comprises a self-locking washer.

7. The combination of claim 3 wherein said block of insulation material comprises expanded polystyrene.

8. The combination of claim 4 further comprising an elongated strap having longitudinally spaced-apart holes therein, said strap being interposed between said panel structure and base plates with said studs inserted through respective holes whereby said strap maintains said insulated support blocks in predetermined spaced-apart relation.

9. The combination of claim 8 wherein said fastening means comprises a plurality of generally inverted L-shaped brackets, each having an upper leg and a lower leg, means for securing said upper leg to the top surface of said panel structure and means for securing said lower leg to a sidewall.

10. The combination of claim 9 wherein said means for securing the upper leg comprises an integral downturned flange on said upper leg adapted to penetrate the top surface of said panel structure.

11. The combination of claim 9 wherein opposite ends of said straps are secured to respective L-shaped brackets.

12. The combination of claim 11 wherein said lower leg of the L-shaped brackets has an opening therethrough spaced from said upper leg by approximately the thickness of said panel structure, said strap including a downturned end portion extended through said opening and means for securing said downturned end portion relative to said lower leg.

13. The combination of claim 12 wherein said means for securing said lower leg to a sidewall and said means for securing said downturned end portion relative to said lower leg comprise a single fastener inserted through said downturned end portion, lower leg and sidewall.

* * * * *